US006360821B1

(12) United States Patent
Braddick

(10) Patent No.: US 6,360,821 B1
(45) Date of Patent: Mar. 26, 2002

(54) COMBINATION WHIPSTOCK AND ANCHOR ASSEMBLY

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 0 days.

(21) Appl. No.: 09/315,875

(22) Filed: May 20, 1999

(51) Int. Cl.[7] ..... E21B 7/06; E21B 23/00; E21B 23/12

(52) U.S. Cl. ..... 166/117.6; 166/216; 166/382

(58) Field of Search ..... 166/117.5, 117.6, 166/216, 382

(56) References Cited

U.S. PATENT DOCUMENTS

| | | | | |
|---|---|---|---|---|
| 3,115,935 A | | 12/1963 | Hooton | 166/117.6 |
| 4,397,355 A | * | 8/1983 | McLamore | 166/297 |
| 5,154,231 A | | 10/1992 | Bailey et al. | 166/298 |
| 5,193,620 A | | 3/1993 | Braddick | 166/382 |
| 5,222,554 A | | 6/1993 | Blount et al. | 166/117.6 |
| 5,335,737 A | | 8/1994 | Baugh | 175/61 |
| 5,467,819 A | | 11/1995 | Braddick | 166/117.6 |
| 5,494,111 A | * | 2/1996 | Davis et al. | 166/382 |
| 5,595,247 A | | 1/1997 | Braddick | 166/297 |
| 5,678,635 A | | 10/1997 | Dunlap et al. | 166/387 |
| 5,785,133 A | * | 7/1998 | Murray et al. | 175/61 |
| 5,909,770 A | * | 6/1999 | Davis | 166/117.6 |
| 6,035,939 A | * | 3/2000 | Carter | 166/382 |

OTHER PUBLICATIONS

Merrian–Webster's Collegiate Dictionary 10th Edition, 1999, p. 853 col. 2.*

* cited by examiner

*Primary Examiner*—David Bagnell
*Assistant Examiner*—Jennifer H Gay
(74) *Attorney, Agent, or Firm*—Browning Bushman

(57) ABSTRACT

A whipstock assembly 10, 110 for setting within a casing C includes a whipstock body 12, 112 having a whipstock diversion face 24, 124 for diverting a tool with respect to the casing. At least one wedge member 32, 132, 133 is moveable relative to the whipstock body and supports one or more wedge slips, 34, 36, 134, 136 thereon for anchored engagement with the casing. The wedge member has a whipstock body engaging surface 98 for sliding engagement with a lower wedge engaging surface 96 on the whipstock body. An elongate rod or other actuation member 40 moves the at least one wedge member from the run in position to the set position. According to the method of the invention, the whipstock and anchor assembly may be run into the well through a tubing string then set in the casing. The whipstock assembly may be of the type which is retrievable to the surface after having been set in the casing.

28 Claims, 10 Drawing Sheets

COMBINATION WHIPSTOCK AND ANCHOR ASSEMBLY

FIELD OF THE INVENTION

The present invention relates to a whipstock of the type commonly used for setting in a casing, cutting a window in the casing, drilling a lateral from the casing into a formation, and/or diverting a downhole tool into a lateral extending from the casing. More particularly, this invention relates to a combination whipstock and anchor tool which may be run in a well at a relatively low cost and reliably set in the well for achieving its diverting function.

BACKGROUND OF THE INVENTION

A whipstock is a downhole diversion tool inserted into a wellbore and used to deflect a drill bit or other tool in a direction that is angularly offset with respect to the orientation of the original wellbore. The deflected mill may thus establish a new or additional drilling path, commonly referred to as a lateral. A whipstock may also divert a slotted liner or other tubular that is run into the drilled lateral. A whipstock positioned in a casing string on an anchor thus provides an angled whipstock diversion face at a desired depth in the wellbore in order to conduct various side tracking or lateral drilling operations through the casing string.

Many whipstocks are run in a well and are set on an anchor which was previously run in the well and fixed into biting engagement with the casing. Downhole anchors are thus conventionally used for supporting a whipstock within a casing string, and in many applications the whipstock may be retrieved to the surface with the anchor left in place. Various types of anchors are thus available for this purpose. A mechanically set anchor for supporting a whipstock in a well is disclosed in U.S. Pat. No. 5,193,620. U.S. Pat. No. 5,335,737 discloses a hydraulically set anchor. Thru tubing anchors for supporting a whipstock are disclosed in U.S. Pat. Nos. 5,595,247 and 5,678,635.

One of the advantages of providing an anchor separate from the whipstock is that a properly set anchor provides a reference point so that the face of the whipstock may be properly oriented to achieve a desired azimuthal direction for the diversion operation. A whipstock may thus be retrieved to the surface and reoriented so that, when later reinserted in the well, the whipstock face will be at a known azimuth relative to the set anchor. An anchor which may be fixed within a well and a whipstock oriented at a desired azimuth relative to the anchor is disclosed in U.S. Pat. No. 5,467,819.

One of the disadvantages with a system which provides an anchor separate from the whipstock is that one trip is generally required to position and set the anchor downhole, then another trip is subsequently used to set the whipstock in the hole on the anchor. A combination whipstock and anchor for setting in a well in one trip is disclosed in U.S. Pat. No. 3,115,935. U.S. Pat. No. 5,154,231 also discloses a combination whipstock and a hydraulically set anchor. A combination anchor and whipstock have been sold by TIW Corporation as the SS-WS Whipstock Packer with Anchor. U.S. Pat. No. 5,222,554 discloses a combination whipstock and anchor, with the anchors consisting of axially spaced pivot members which swing out from the whipstock body. U.S. Pat. No. 5,494,111 discloses a permanent whipstock and anchor tool which similarly uses pivoting anchor members.

A significant problem with the combination whipstock and anchor assemblies known in the prior art is cost of these tools, and/or problems associated with reliably setting the tools in the casing. The anchor components of many of these prior art tools are quite complex and expensive. Other tools, such as those using anchor members which pivot with respect to the whipstock body, do not provide reliable engagement with the casing. If the operator cannot rely on the anchor remaining in place when the mill or other tool engages the anchor, the whipstock will not be widely accepted in the industry.

The disadvantages of the prior art are overcome by the present invention, and an improved whipstock and anchor are hereinafter disclosed. The combination whipstock and anchor of the present invention may be provided at a relatively low cost, yet may be reliably set in a casing and remain in the set position during the various diversion operations. In one embodiment, the combination whipstock and anchor is retrievable to the surface. The whipstock and anchor may also be used in thru tubing operations.

SUMMARY OF THE INVENTION

A combination whipstock and anchor assembly includes a whipstock body having a whipstock diversion face, at least one wedge member movable relative to the whipstock body, and an actuation member for moving the at least one wedge member from a run in position to a set position. The whipstock body includes a lower wedge engaging surface, and a wedge member has a whipstock body engaging surface in sliding engagement with the wedge engaging surface. The wedge member may support one or more wedge slips for anchored engagement with the casing. The combination whipstock and anchor assembly may be used in conventional or thru tubing operations, and if desired the whipstock may be retrieved to the surface after the setting operation.

In a preferred embodiment, the actuation member includes an elongate rod moveable within a thru bore provided in the whipstock body. A hydraulic actuator may be positioned above the whipstock body for moving the elongate rod from the run in to the set position. The rod may be provided with a shear member to shear after the wedge member has been moved to the set position.

In one embodiment, two axially spaced slips are provided on the wedge member. The circumferentially opposing surface of the whipstock body engages the casing in one embodiment, while in another embodiment at least one slip provided on the whipstock body engaging the casing. The wedge engaging surface and the whipstock body engaging surface may be provided with a dovetail interconnection. A counterbalance may be provided for positioning the whipstock body in the well prior to setting the whipstock assembly.

A ratchet mechanism may be positioned within the thru bore of the whipstock body below the shear member for retaining the whipstock body and a wedge member in the set position. In one embodiment, the back surface whipstock body circumferentially opposite the whipstock diversion surface is spaced from the casing so that the whipstock is effectively "tilted" within the casing when in the set position. In the latter embodiment, the whipstock diversion face may have a substantially uniform depth cut in the whipstock body.

A plurality of wedge members may be provided, with one of the wedge members engaging the lower wedge engaging surface on the whipstock body. Each of the wedge members is slidably movable relative to the whipstock body and to another of the wedge members.

The elongate rod may include a bushing slidable within the thru bore. A lower rod portion may be pivotally interconnected with the bushing and the lower wedge member.

An upper portion of whipstock body may include a whipstock retrieval surface for engaging a retrieval tool to retrieve the whipstock and anchor assembly to the surface.

According to the method of the present invention, the whipstock body and the at least one wedge member having a wedge slip supported thereon are run into a well and into the interior of a downhole casing. Thereafter the elongate rod is moved relative to the whipstock body from a run in position to a set position, thereby moving the at least one wedge member to the set position.

The whipstock body and the at least one wedge member in the run in position may be passed through a tubing or other restriction in a casing, and thereafter set within that casing or another casing at a location below the restriction. An actuator may be positioned above the whipstock member, and a shear member may be provided in the elongate rod. The actuator may be activated to shear the shear member after moving the elongate rod to the set position, and thereafter the actuator may be retrieved to the surface. A retrieval surface may be provided on the whipstock body for engagement with a retrieval tool while in a set position.

It is an object of the present invention to provide an improved whipstock and anchor assembly and an improved method for setting a whipstock and anchor assembly in a casing. If desired, the assembly and the method of the present invention may be used in thru tubing operations wherein the tubing O. D. is less than the I.D. of the casing. The whipstock and anchor assembly may also be retrieved to a surface through the tubing after being set in a well.

It is a related object of this invention to improve the reliability of setting a relatively low-cost whipstock assembly in a casing. An elongate rod may be provided for moving the wedge member from the run in position to the set position. The whipstock body, the wedge member, and the rod may be lowered into a well, then the elongate rod moved from a run in position to a set position, thereby moving the wedge member to the set position.

A significant feature of the present invention is that the whipstock and anchor assembly provides an effective and reliable mechanism for effectively securing the position of a whipstock body in the casing. The whipstock and anchor assembly may be provided at a relatively low cost, thereby facilitating the economical recovery of hydrocarbons.

An advantage of the present invention is that the whipstock and anchor assembly may include a ratchet mechanism which ensures that the assembly remains in the set position until it is intentionally disabled.

Another advantage of this invention is the reliability of the whipstock setting operation, which is enhanced by utilizing an elongate rod to move the whipstock assembly components to a set position.

These and further objects, features and advantages of the present invention will become apparent from the following detailed description, wherein references is made to the figures in the accompanying drawings.

DETAILED DESCRIPTION OF PREFERRED EMBODIMENTS

Figure 1A:
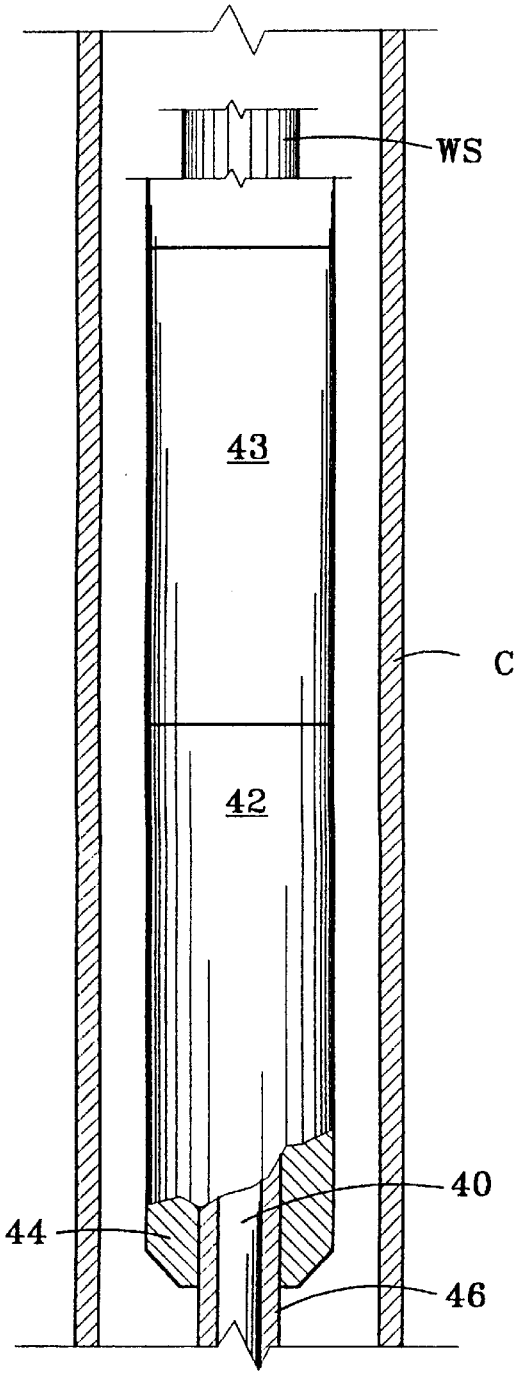
FIGS. 1A, 1B, 1C, 1D and 1E illustrate successively lower portions of a whipstock and another assembly, partially and cross section, in the run in position for passing downhole into a wellbore.

FIG. 1 consists of FIGS. 1A, 1B, 1C, 1D, and 1E, which are successibly lower portions of a suitable whipstock and anchor assembly 10 according to the present invention. Assembly 10 is shown in FIG. 1 in the "run in" position, e.g., its position when lowered into the well. In the following description, the whipstock and anchor assembly 10 is discussed for positioning within a vertical borehole. Those skilled in the art will appreciate that the assembly and method of the present invention are conventionally used in inclined or deviated boreholes, although for ease of explanation the wellbore axis for the following description will be considered vertical. Also, those skilled in the art will appreciate that the terms "upper" and "lower" are used herein with reference to such vertical orientation, which should not be construed in a limiting sense.

The particular embodiment of the whipstock and anchor assembly shown in FIG. 1 is a non-retrievable assembly, i.e., an assembly which is set in a well and thereafter indefinitely remains in the well, although it later may be drilled out or otherwise dropped to a lower portion within the well. The assembly 10 consists of the whipstock body 12 as shown in FIGS. 1C and 1D in the run in position and in FIGS. 2A, 2B, and 2C in the set position, i.e., fixed within the casing C. It should be understood that the length of the whipstock body 12 will depend upon the well conditions and the casing size. In an exemplary application, the whipstock body 12 may have a length of from 8 feet to 12 feet. Those skilled in the art will appreciate that the full length of whipstock body is not shown in the figures since a complete showing is not necessary for an understanding of the invention. The assembly 10 in the run in position may have a maximum diameter of about 3.5 inches, and may be set in a casing C having an interior diameter of about 4.5 inches. The whipstock body includes a concave diversion face 24 which directs the mill or other tool with respect to the casing C such that the whipstock performs its diverting function. Wedge member 32 as shown in FIGS. 1D and 1E is provided at the lower end of the whipstock body, and is shown in FIG. 2C in its set position. The wedge member 32 in cooperation with the whipstock body form the anchor 14 for securing the assembly 10 in the casing.

Returning to FIG. 1A, the whipstock and anchor assembly 10 may be lowered in a well on a work string W S. In an exemplary application, the work string W S may be coiled tubing which efficiently allows the assembly to be lowered in the well and then positioned at a desired location within the casing C. In alternate embodiments, the work string may be composed of threaded joints of tubing, or the work string may be a wireline used to lower the assembly 10 into the well. Secured to the work string W S is an actuator 42, which in a preferred embodiment may be a hydraulic actuator which is responsive to fluid pressure in the casing C. Various types of actuators may be used in accordance with the present invention, and various downhole actuators from numerous downhole tool vendors are commercially available. Sleeve 46 extends downward from the actuator housing 44, and a rod 40 is positioned within sleeve 46 and is movable by the actuator axially with respect to the sleeve 46. In the actuator of the present invention, the sleeve 46 is stationary with respect to the housing 44, and the actuator moves the rod 40 with respect to the sleeve. In other embodiments, however, the actuator 42 may move a sleeve with respect to the housing. As explained subsequently, movement of the rod 40 with respect to the sleeve 46 moves the whipstock and anchor assembly 10 from the run in position to the set position.

FIG. 1 also depicts an orientation tool 43 which may be used for orienting the whipstock at a selected azimuth within the well. The orientation tool may be provided above the whipstock body and either above or below the counterbalance discussed subsequently. The orientation tool 43, a survey tool, or other downhole tool which may thus be conventionally used in whipstock setting operations may be employed with the assembly 10 discussed below.

For the embodiment that is shown in FIG. 1, one or more centralizers 48 are provided at varying locations above the whipstock body. The centralizer 48 includes a bow spring or other centralizing member 50 which is rotationally attached to sleeve 46 by upper and lower end members 52. The rod 40 continues to pass down through the centralizer, and as shown in FIG. 1B, continues into a thru bore provided in the upper end member 56 of the counterbalance 54. The sleeve 46 is thus threaded at 55 to the counterbalance 54, and one or more circumferentially spaced set screws 58 may rotatably lock the position of the sleeve 46 with respect to the counterbalance 54. The counterbalance 54 may be provided for counter to offset the weight of the whipstock 12, and more importantly for ensuring that, when assembly 10 is set in the casing C as the described subsequently, the back surface 53 of the counterbalance will engage the low side of the casing C. The counterbalance housing 54 may have a length sufficient to provide the weight required to ensure that the back side 53 rotates the assembly to the low side of the casing, which then ensures that the concave whipstock diversion face 24 faces the preselected orientation.

Figure 1B:
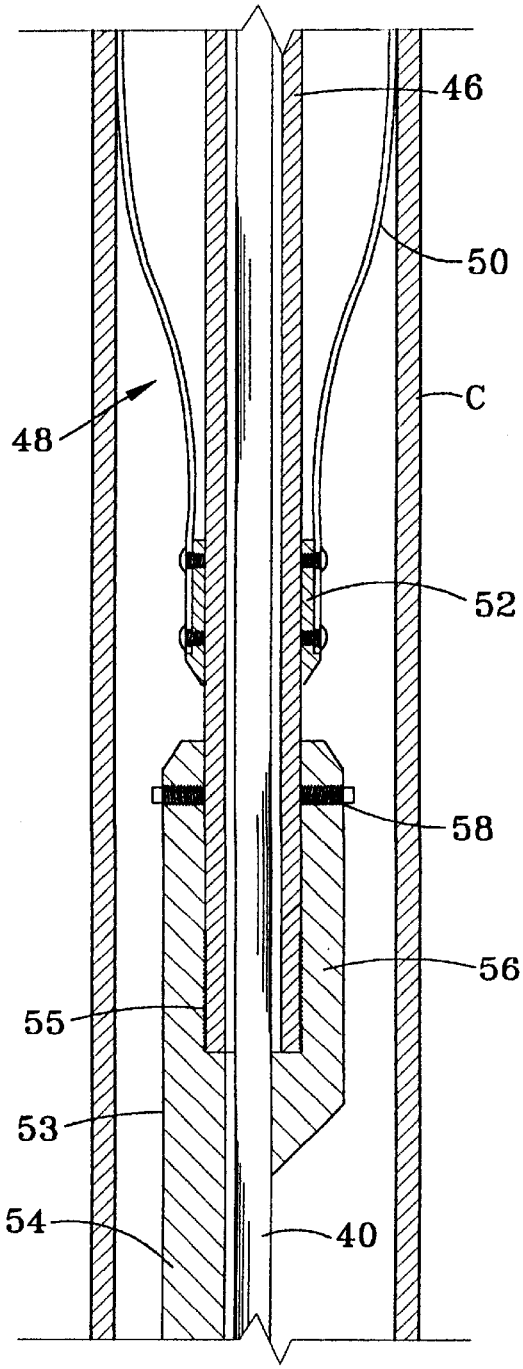
Figure 1C:
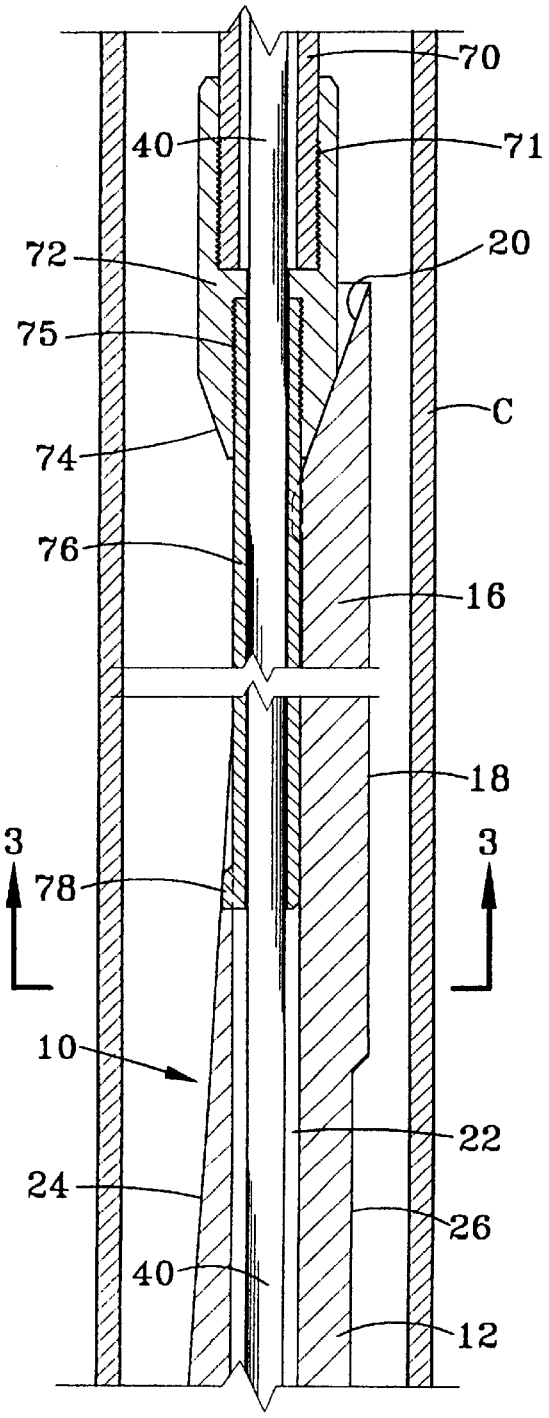

Referring now to FIGS. 1B and 1C, it should be understood that the body of the counterbalance 54 functions to transmit the whipstock supporting load from the sleeve 46 to the sleeve 70, and that the rod 40 passes along the length of the counterbalance 54 and then through the sleeve 70. The lower end of sleeve 70 is threaded at 71 to engage an adaptor 72. A setting sleeve 76 is similarly threaded to the adaptor 72 by threads 75. The lower end of the adaptor 72 includes a concave surface 74 which may be angled for mated planar engagement with initial diversion surface 20 at the uppermost end of the whipstock body 12.

Those skilled in the art will appreciate that the upper end 16 and whipstock body 12 may have an axial length of several feet or more, and that the back surface 18 of the upper end 16 of whipstock body 12 may be machined for planar engagement with the interior surface of the casing C when the assembly 10 is in the set position. The lower end of the sleeve 76 may be provided with a key 78 for fitting within a suitable slot 79 (see FIG. 2B) in the whipstock body, thereby allowing the orientation of the diversion face 24 of the whipstock body 12 to be circumferentially offset with respect to the back surface 53 of the counterbalance 54 which, as previously noted, rotates to the low side of the casing C. At least limited directional control of the whipstock diversion face 24 is thus possible according to the assembly 10 of the present invention.

Figure 1D:
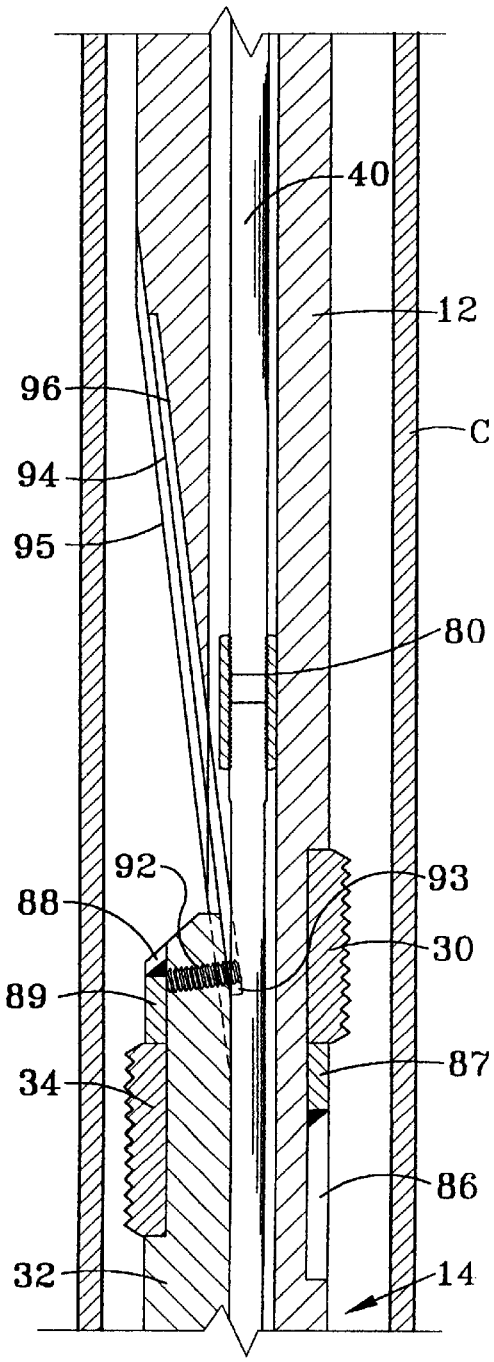

The rod 40 extends down bore 22 provided in the whipstock body along the length of the concave whipstock diversion face 24 which, as previously noted, may have an axial length in excess of several feet. The lower end of the whipstock body 12 is shown in FIG. 1D, and includes a lower wedge engaging surface 95. As previously noted, the assembly 10 as shown in FIG. 1 is a non-retrievable whipstock, and accordingly one or more slips 30 may be provided on the whipstock body for engaging the casing. It should be understood that a substantial length of whipstock body 12 may include a back side undercut 26 (see FIGS. 1C and 2C), such that when the whipstock is in the set position, as explained subsequently, only the upper surface 18 on the whipstock body and the one or more slips 30 at the lower end of the whipstock body engage the casing.

Figure 1E:
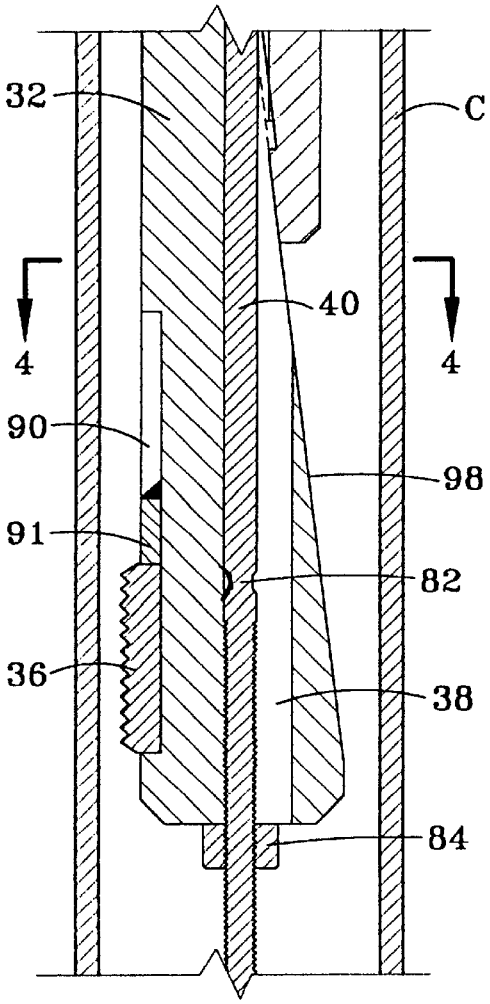

A single wedge 32 is provided in the assembly 10, as shown in FIGS. 1D and 1E, although as explained subsequently two or more wedge members may be employed. Wedge 32 includes a whipstock body engaging surface 98 such that sliding engagement of the surfaces 95 and 98 moves the whipstock body from the run in position to the set position. One or more connector sleeves 80 may be positioned within the bore of whipstock body to interconnect lengths of the rod 40 which, as shown in FIG. 1E, also preferably includes a shear portion 82. The lower end of the rod 40 may be threaded for engagement with a conventional nut 84, which supports the wedge 32 thereon. The wedge 32 includes an enlarged bore 38 or a slotted axial hole for receiving the rod 40. The size of the bore 38 in the wedge 32 may be increased by increasing the diameter of the nut 84 or by using an enlarged washer (not shown).

The slip 30 may be fixedly mounted to the body 12 by a conventional dovetail interconnection. Slip 30 may be thus positioned within dovetail slot 86 and into engagement with a stop surface on the body 12. To secure the slip 30 in this desired position, a retainer 87 may be provided, with the retainer then being welded to the whipstock body 12 and avoiding problems of welding the slip 30 directly to the body 12. With the embodiment as shown in FIG. 1, the wedge 32 is provided with an upper slip 34 and a lower slip 36. Those skilled in the art will understand that one or more slips may be provided on the wedge. The slip 34 is similarly positioned within a dovetail slot 88 and is held in place by retainer 89, while the slip 36 is positioned within the dovetail slot 90 and is held in place by the retainer 91. The combination of the wedge 32 with the one or more slips 34, 36 and the lower end at the whipstock body 12 with the optional slip 30 thus effectively forms the anchor 14 which fixes the position of the whipstock body within the casing C. FIG. 1D shows an Allen bolt or other guide member 92 in engagement with an end surface 93 along the tapered surface 96, thereby limiting downward movement of the wedge 32 with respect to the whipstock body 12 when the assembly 10 is run in the well. Mated engagement of the surfaces 96 and 98 are maintained by a dovetail interconnection, which includes a conventional dovetail extension in one member and a corresponding slot 94 in the other member.

Figure 2A:
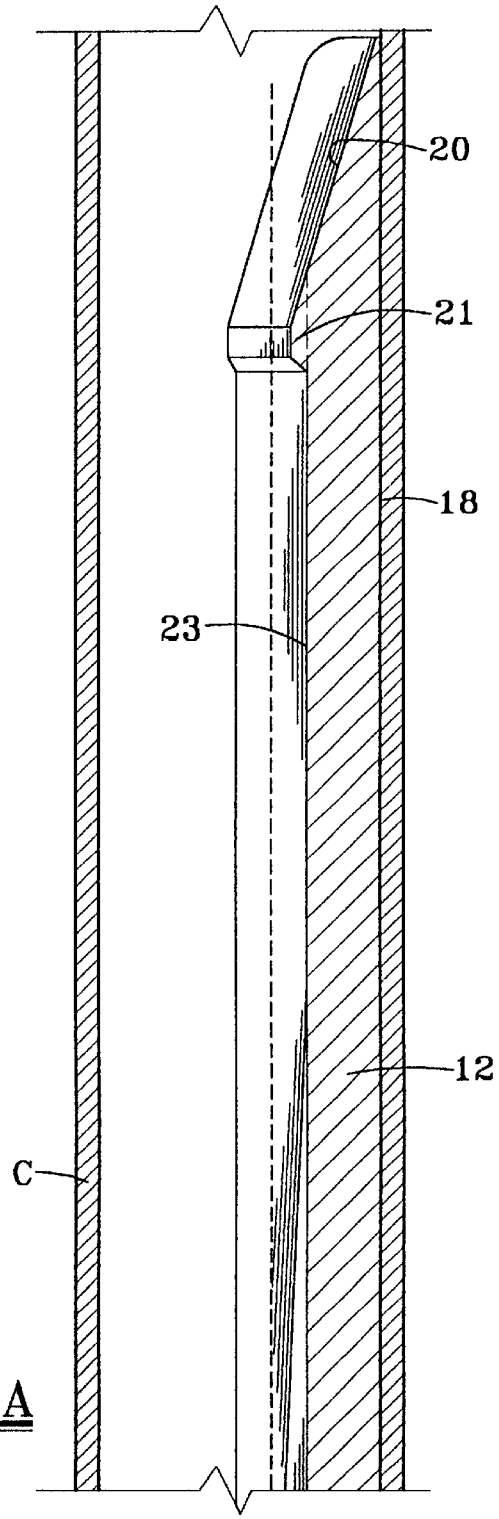
FIGS. 2A, 2B and 2C illustrate the whipstock and anchor assembly in the set position within a casing.
Figure 2B:
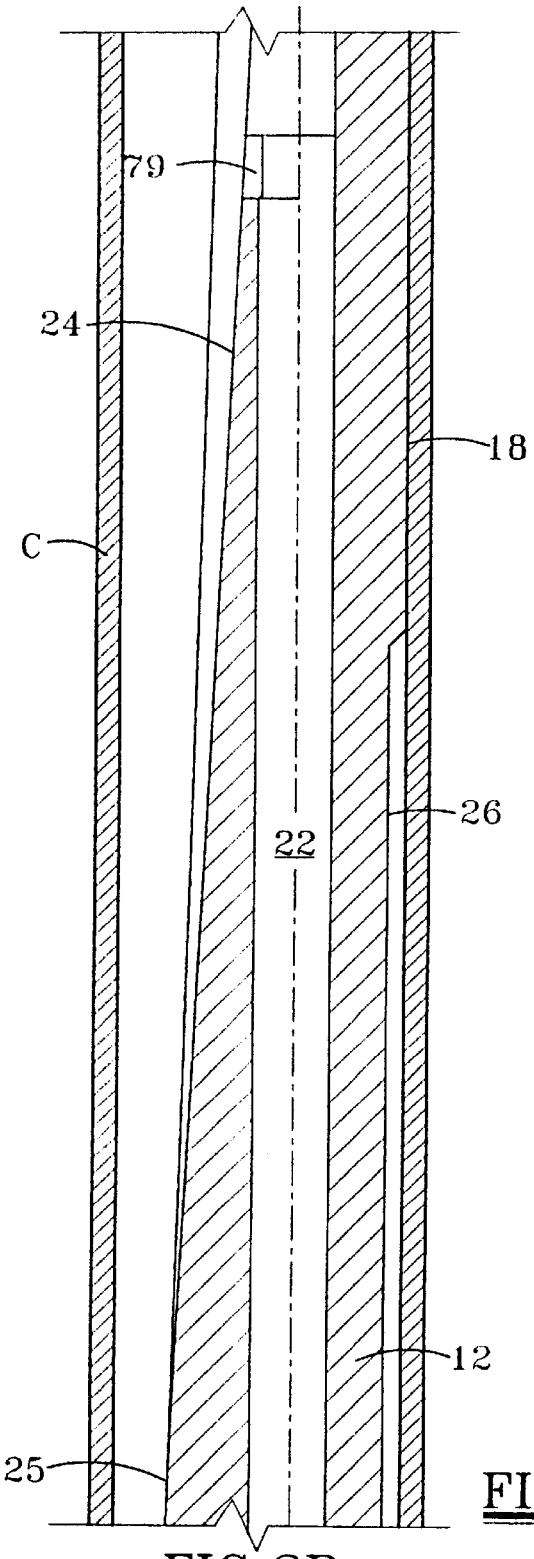
Figure 2C:
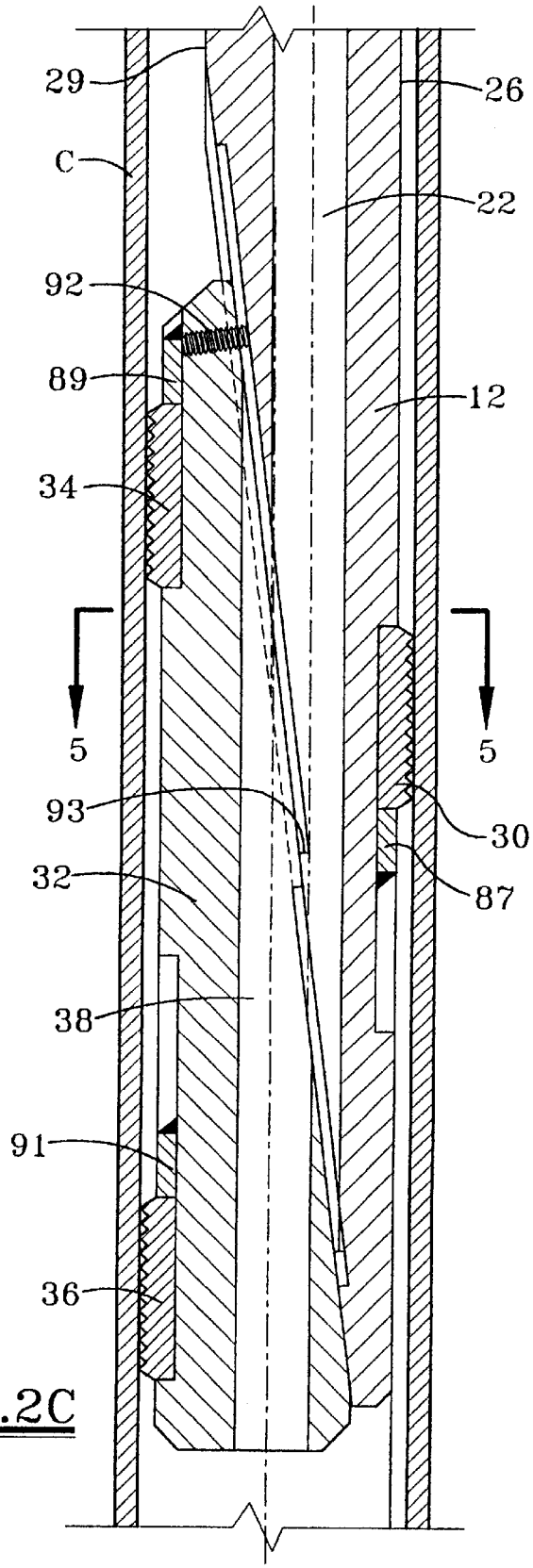

The method of setting the whipstock assembly 10 may be understood by comparing FIG. 1 with FIG. 2, which consists of FIGS. 2A, 2B, and 2C illustrating portions of the whipstock body 12 and the anchor 14 in the set position. When the assembly 10 is at its desired depth within the casing, the low side 53 of the counterbalance 54 will rotate the assembly to the low side of the casing, and the concave whipstock face 24 will direct a mill or other tool to engage the selected casing exit position. As previously noted, however, a face 24 may be angled with respect to the low side reference point provided by the counterbalance 54. Once properly positioned, downhole hydraulic pressure may be increased, thereby increasing the pressure to which the hydraulic actuator 42 is subjected. As this pressure rises above a minimum level, the actuator 42 may pull up on the rod 40 relative to the sleeve 46, thereby moving the wedge 32 upward with respect to the whipstock body 12, and inherently causes the distance between the otherwise cylindrical outer surface of the assembly 10 to increase as the surface 98 moves upward along the surface 95. This upward movement of the rod 40 and the wedge 32 with respect to the whipstock body 12 will continue until the upper and lower slips 34 and 36 engage the interior of the casing C, thereby also forcing the whipstock body slip 30 into engagement with a circumferentially opposing side of the casing C, such that whipstock body 12 and the wedge 32 will be positioned as shown in FIG. 2C. Those skilled in the art will appreciate that the slips 34, 36, and 30 conventionally include teeth for biting engagement with the interior of the casing, although that biting engagement is not shown in FIG. 2C. The angle of the rotating surfaces 98 and 95 when the assembly 10 is in the set position and the biting engagement of the slips with the casing are sufficient to ensure that the assembly, once set with the desired pull force on the rod 40, will remain in that set position. Once the reliable setting has been obtained, further upward pull on the rod 40 will shear the shear stud portion 82 in the rod, thereby allowing the hydraulic actuator 42 and most of the rod 40 to be retrieved to the surface, with the whipstock body 12 and the anchor 14 set in the well.

When the assembly 10 has been set within the casing, a cutting mill or other suitable tool may be lowered in the well and brought into engagement with the upper end surface 20 on the whipstock body 12. The upper end of the whipstock body may be provided with the lug 21 as shown in FIG. 2A, with the lug ensuring that the mill cuts into the casing to cut a window in the casing. The back side 18 at the upper end of the whipstock body is in planar engagement with the casing C. Once the mill cuts through the casing wall, the cut in the casing may be lengthened by providing a concave guiding surface 23 on the upper end of the whipstock body 12, with the concave guiding surface 23 being parallel to the central axis of the casing. The window is thus only lengthened and not widened as the mill moves downward along the surface 23. The mill may then engage a concave tapered diversion face 24 which, in the set position, is angled with respect to the central axis of the casing so that, as the mill moves downward along the tapered surface 24 as shown in FIG. 2B, the window in the casing is both lengthened and widened. The tapered surface 24 as shown in FIG. 2B "runs out" or intersects the diameter of the whipstock body 12 at point 25 on the whipstock body, which thereafter provides a separation so that the cutting mill will not engage the upper end of the anchor 14 when it mills through the casing. The surface 29 of the whipstock body along this separation portion of the whipstock may thus be parallel to the interior wall of the casing C.

FIG. 2C illustrates an enlarged bore 38 or a slotted axial hole in the wedge 32 and the bore 22 in the whipstock body 10 when the assembly 10 is in the set position. Just prior to shearing, the rod 40 may thus be pushed up against one side of the bore 22 and against a circumferentially opposing side of the bore 38. The lower end of the rod 40 and the nut 44 may simply drop in the well once the assembly 10 is set and member 82 shears.

Figure 3:
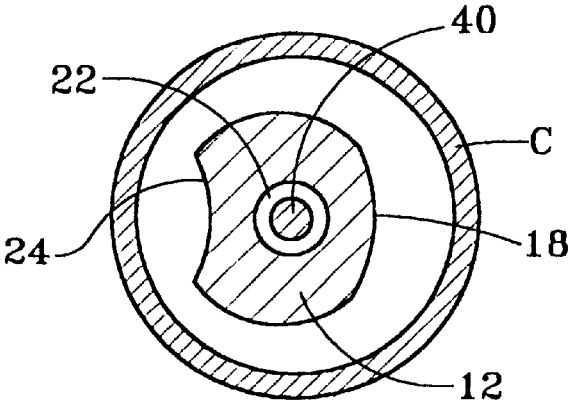
FIG. 3 is a cross section taken along lines 3—3 in FIG. 1C.

FIG. 3 is a cross-sectional view taken along lines 3—3 and FIG. 1C. The whipstock body 12 has a back surface 18 configured for planar engagement with the interior wall of the casing C. Rod 40 passes downward through the bore 22 in the whipstock body. The front face of the whipstock body is provided with a tapered concave whipstock diversion face 24 which, as explained above, diverts the mill or other tool with respect to the casing C.

Figure 4:
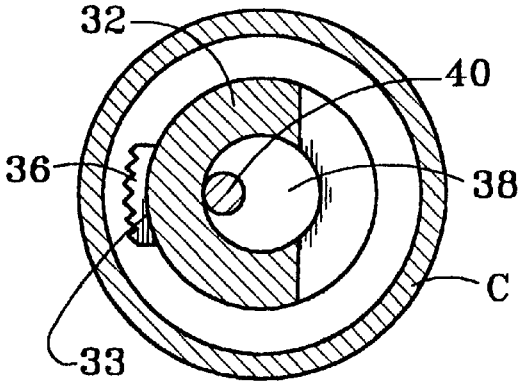
FIG. 4 is a cross section taken along lines 4—4 in FIG. 1E.

FIG. 4 is a cross-sectional view taken along lines 4—4 and FIG. 3 and shows the wedge 32 in the run-in position within the casing C, with the slip 36 extending outward from the outer surface of the wedge. Those skilled in the art will appreciate that the teeth on the wedge 36 extend outward from the outer surface 33 on the wedge, although this extension has been exaggerated in FIG. 4 for clarity. The position of the rod 40 within the enlarged bore 38 is also shown FIG. 4.

Figure 5:
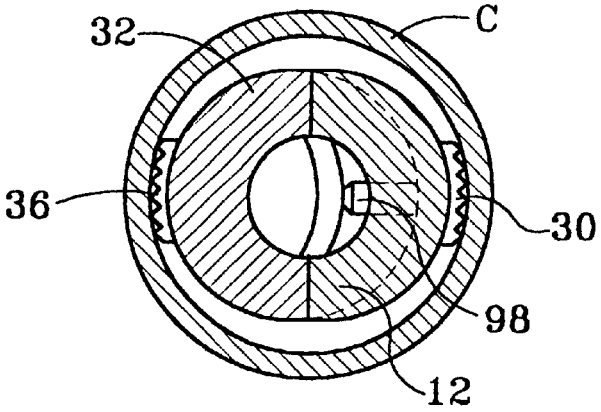
FIG. 5 is a cross section taken along lines 5—5 in FIG. 2C.

The position of the wedge 32 and the whipstock body 12 within the casing in the set position may be viewed in FIG. 5. Both the lower slip 36 and the whipstock body slip 30 are thus shown in engagement with the interior wall of the casing C. The dovetail interconnection between the wedge 32 and the whipstock body 12 may be better understood by reference to FIGS. 8 and 9, which illustrate similar dovetail connections between wedge components and the whipstock body in an alternate embodiment of the invention. Further details regarding a dovetail connection and the use of limiting pins to restrict movement of sliding components relative to each other is disclosed in U.S. Pat. No. 5,678,635 hereby incorporated by reference.

During the discussion of the whipstock and anchor assembly 10, it was noted that a component, such as the slips 34 and 36, may engage the casing at a location circumferentially opposite of the location where another component, such as slip 30, engages the casing. It should be understood that the term "circumferentially opposite" should not be construed to be limited to a location which is 180 degrees opposite the location of the other component. Instead, the term "circumferentially opposite" as used herein is meant in its broader sense and may thus indicate that component contacts a side of the casing while another component contacts a circumferentially opposing side of the casing 12. For example, it should be understood that the slips 34 and 36 may contact the casing at a location spaced 170 degrees and 190 degrees, respectively, opposite the contact location of the slip 30 with the casing. Each of these slips 34 and 36 are nevertheless circumferentially opposite the slip 30. Those skilled in the art will appreciate that each of the slips has an axial and circumferential length to provide the desired gripping engagement. The shape and material of each slip will depend upon various conditions, including the material of casing C.

FIG. 6 illustrates an alternate embodiment of a combination whipstock and anchor assembly 110 according to the present invention in the run in position, while in FIG. 7 components of this assembly are shown in the set position within the casing C. As shown in FIG. 6A, a bow spring centralizer 148 includes a plurality of circumferential bow springs 150, with the centralizer lower end piece 152 being rotationally fixed to the sleeve 146. Actuator 142 is also suspended in the well from the work string, and the lower end of the actuator 142 has been modified to include a keyed ball and socket pivot 143, thereby allowing both the sleeve 146 and the rod 140 to pivot and flex respectively with respect to the actuator housing 144. As with the actuator 42, the activation of hydraulic actuator 142 may pull the rod 140 up with respect to the sleeve 146 and the actuator housing 144.

Figure 6A:
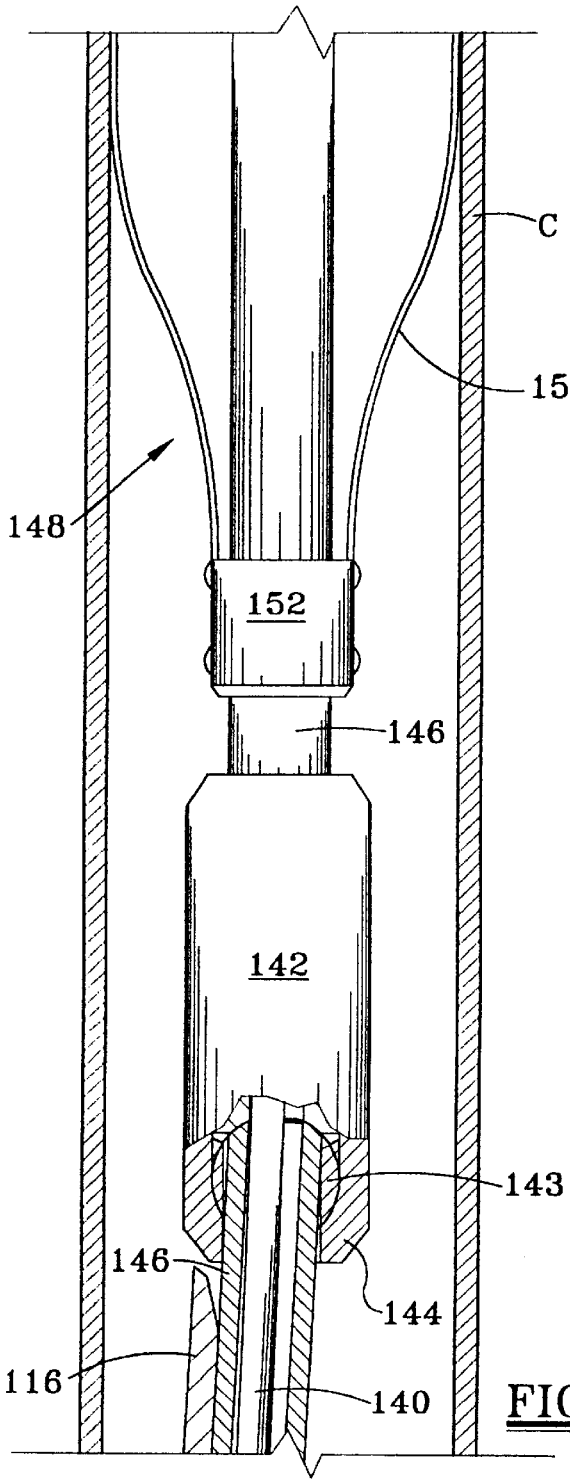
FIGS. 6A, 6B, 6C, 6D, and 6E illustrate successively lower portions of an alternative embodiment of the whipstock and anchor assembly, partially in cross section, in the run position for passing through a restriction wellbore.
Figure 6B:
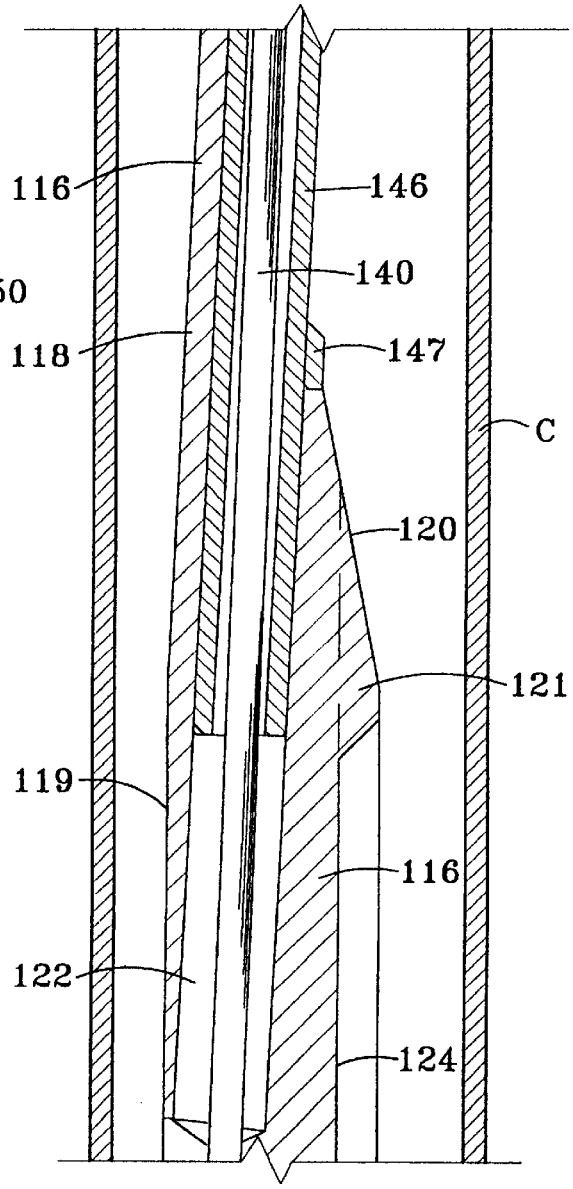
Figure 7A:
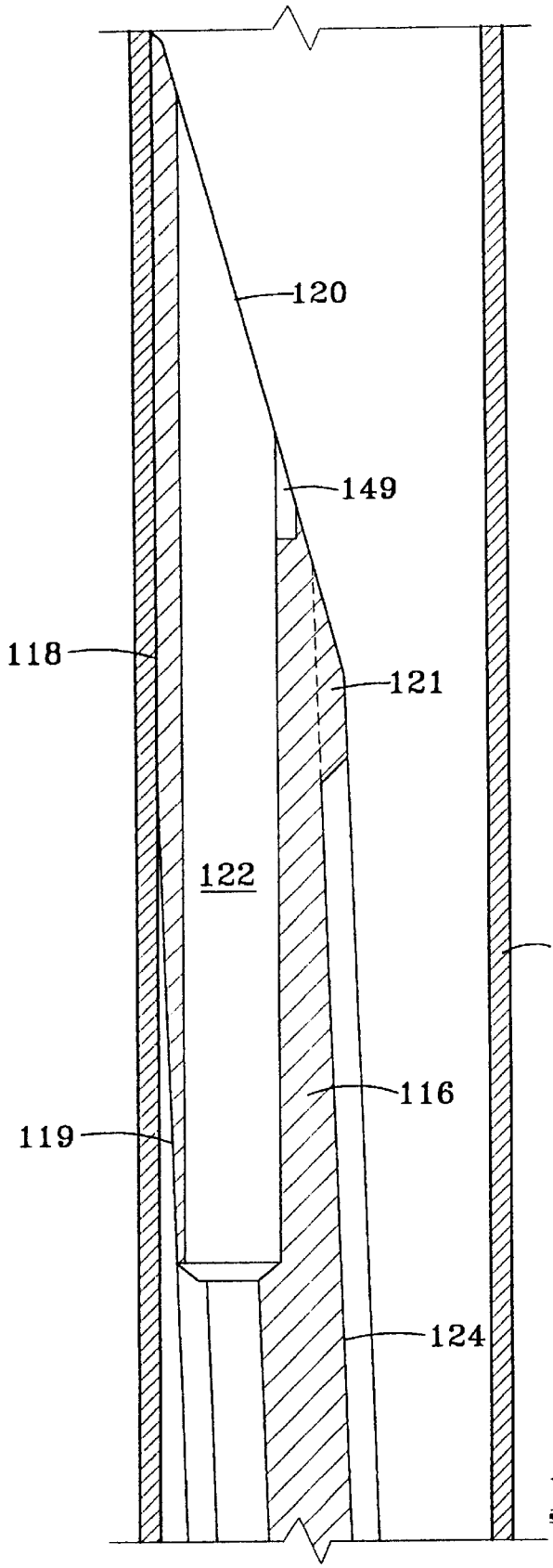
FIG. 7A, 7B, 7C, and 7D illustrate the whipstock and anchor assembly as shown in FIG. 6 in the set position within a casing.

FIG. 6A also illustrates the uppermost end 116 of the whipstock body 112. A lug 147 affixed to the sleeve 146 may be fitted within a suitable slot 149 as shown in FIG. 7A for rotatably securing the position of the whipstock body with respect to the sleeve 146. As noted above, the back surface 118 of the whipstock body preferably is machined for planar engagement with the internal surface of the casing C when the assembly 110 is set in the well. When in the set position, whipstock may be tilted within the casing and, as shown in FIG. 7A, the back surface section 118 is machined to the same angle, but in the reverse direction, as the whipstock body tilt, so that the back surface 119 of the whipstock body will then be tilted out of engagement by the same angle with the internal surface of the whipstock body. Similarly, the lower front surface 115 is machined to have the same reverse angle, thereby permitting planar engagement of the front surface 115 of the whipstock body with the casing when in the set position. The whipstock body includes a thru bore 122 for receiving the rod 140. A lug 121 is provided on the upper end 116 of the whipstock body for engagement with a mill to make an initial window cut in the casing C. Thereafter the mill will continue down the concave whipstock diversion face 124 shown in FIG. 6B.

Figure 6C:
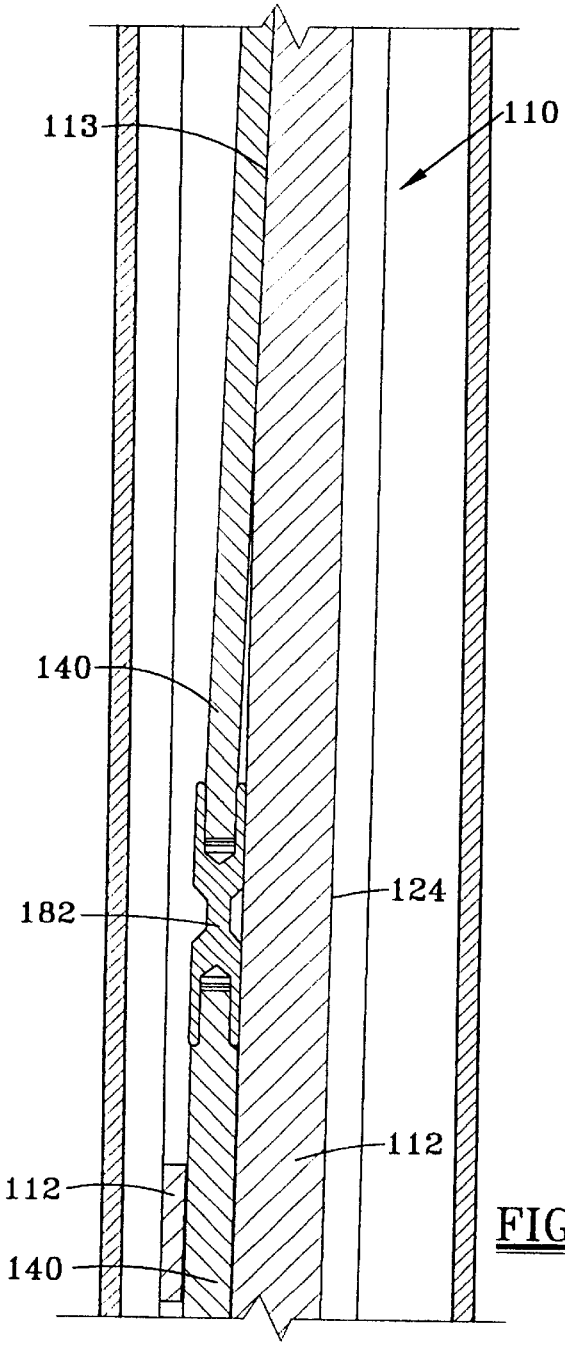

The whipstock assembly 110 may be a "thru tubing" assembly. In an exemplary application, the assembly 110 in its run in position has a maximum diameter of about 3.7 inches, and the whipstock and anchor assembly may be reliably set within casing having an interior diameter of approximately 6 to 9 inches. The assembly 110 may thus be run through a tubing string and lowered beneath a lowermost end of the tubing string to be set within the casing at a selected depth below the tubing string. Again, those skilled in the art will appreciate that the entire length of the whipstock body 112 is not shown in the figures, and in a conventional application the whipstock body 112 may have the length of from eight feet to ten feet or more. As shown in FIG. 6C, the rod 140 may have different diameters along its length. The rod 140 may also be formed from different methods, and may have various shapes and functional components along its length.

Referring to FIG. 6C, the back side of the whipstock body 112 may have an elongate slot 113 for receiving a portion of the rod 40 when the assembly is run in the well. A shear member 182 may be provided along the length of the rod 140 for subsequently shearing upon the application of a preselected force along the rod 140. At one or more points along the length of the whipstock body, the back slot of the whipstock body may be eliminated so that the rod passes through a bore provided in the whipstock body, with the side walls of the bore thus providing a guiding function to the rod 140, as shown in the lowermost portion of FIG. 6C.

Figure 6D:
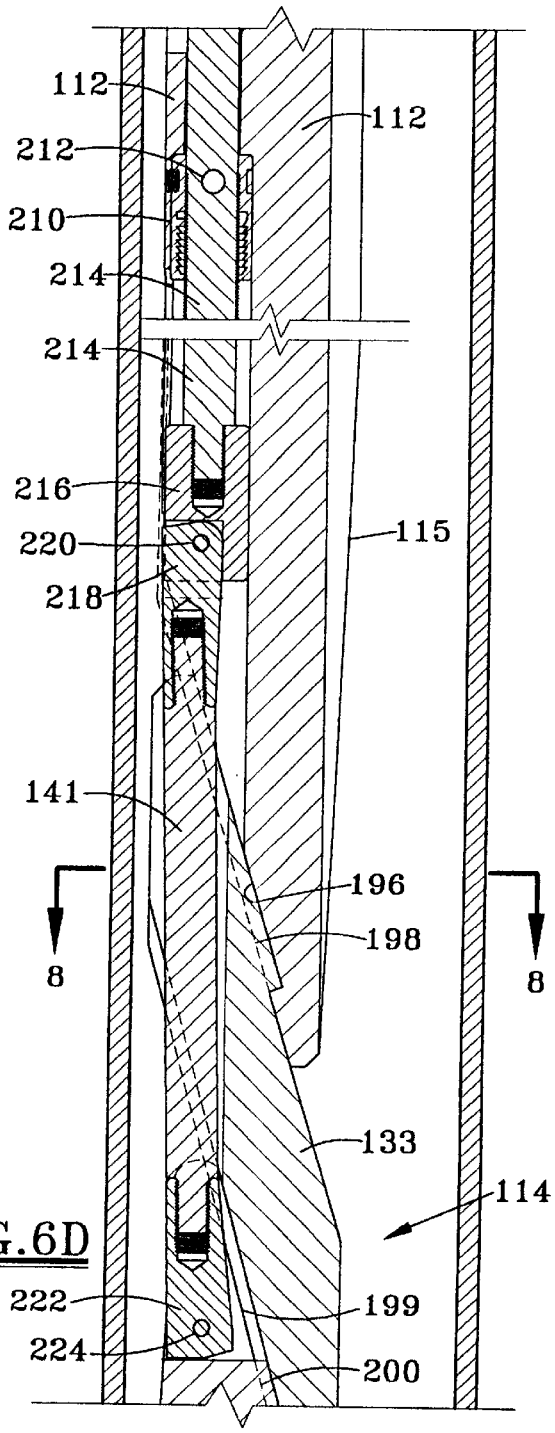
Figure 6E:
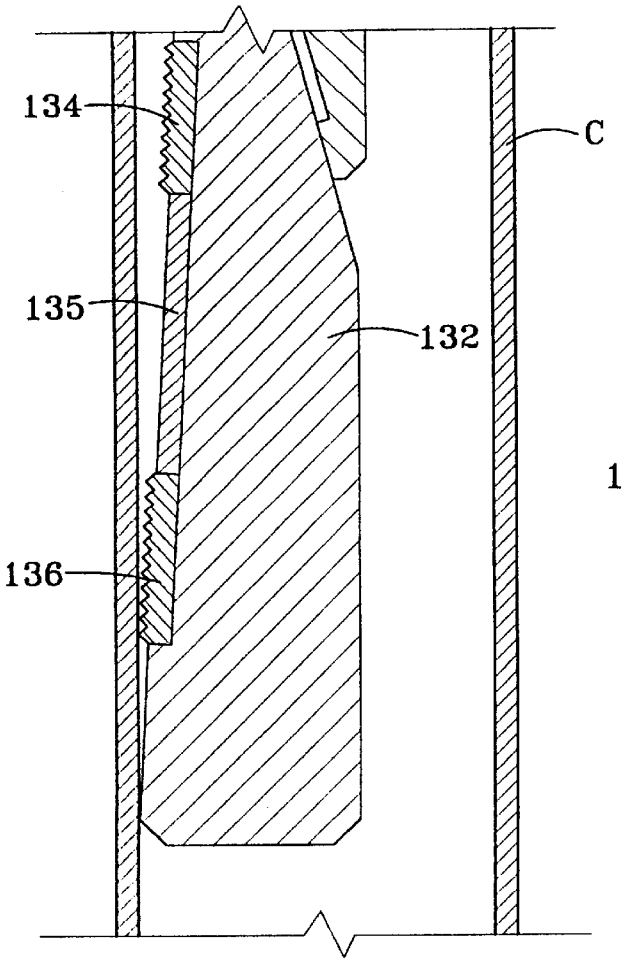

A latching rod or latching mandril 214 as shown in FIG. 6D may be attached to or be considered part of the rod 140. A conventional latch assembly 210 may be provided within the whipstock body, with the latch assembly being connected to the body 112 by a plurality of circumferentially spaced shear members 212. The latching rod 214 extends downward into threaded engagement with connector bushing 216, which is axially moveable within an elongate slot within the body 112. Hinge member 218 is pivotally connected to the bushing 216 by hinge pin 220, and rod extension 141 is threadably connected at one end to the hinge 218 and at the other end to a similar hinge 222 connected by pivot 224 to the wedge 132. The whipstock body 112 includes a lower wedge engaging surface 198 for sliding engagement with a whipstock body engaging surface 196 on the upper wedge member 133. A lower surface on the upper wedge 133 is provided with a similar surface 200 for providing sliding engagement with surface 199 on the lower wedge 132. FIG. 6E illustrates that the wedge 132 supports an upper slip 134 and a lower slip 136 thereon, with a spacer 135 sandwiched therebetween.

Figure 7B:
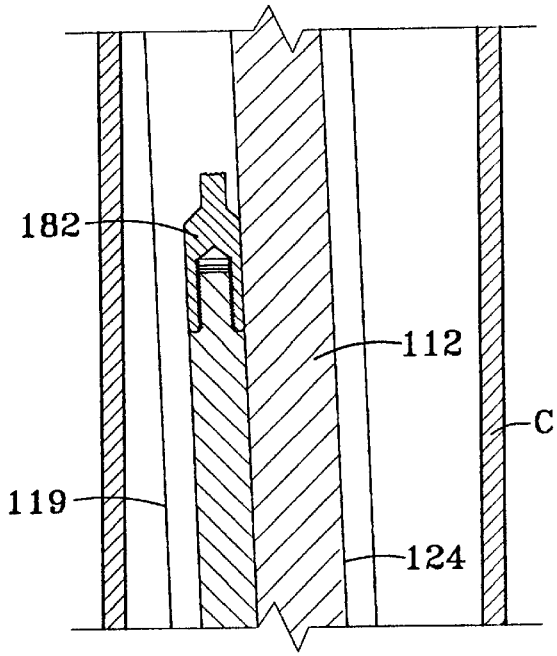
Figure 7C:
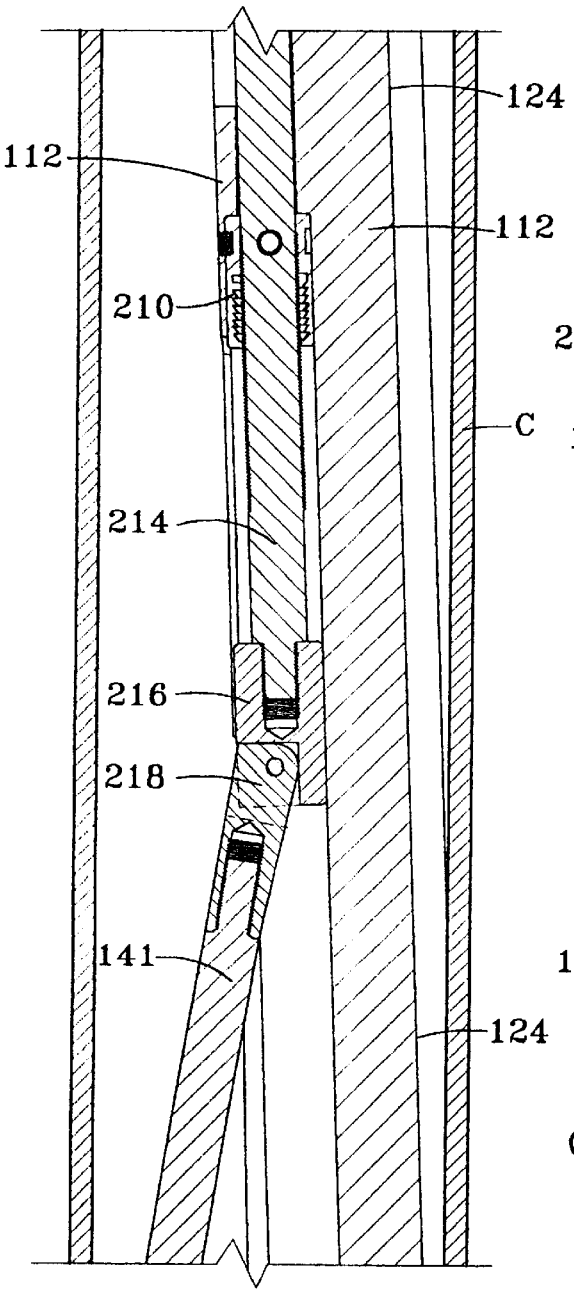
Figure 7D:
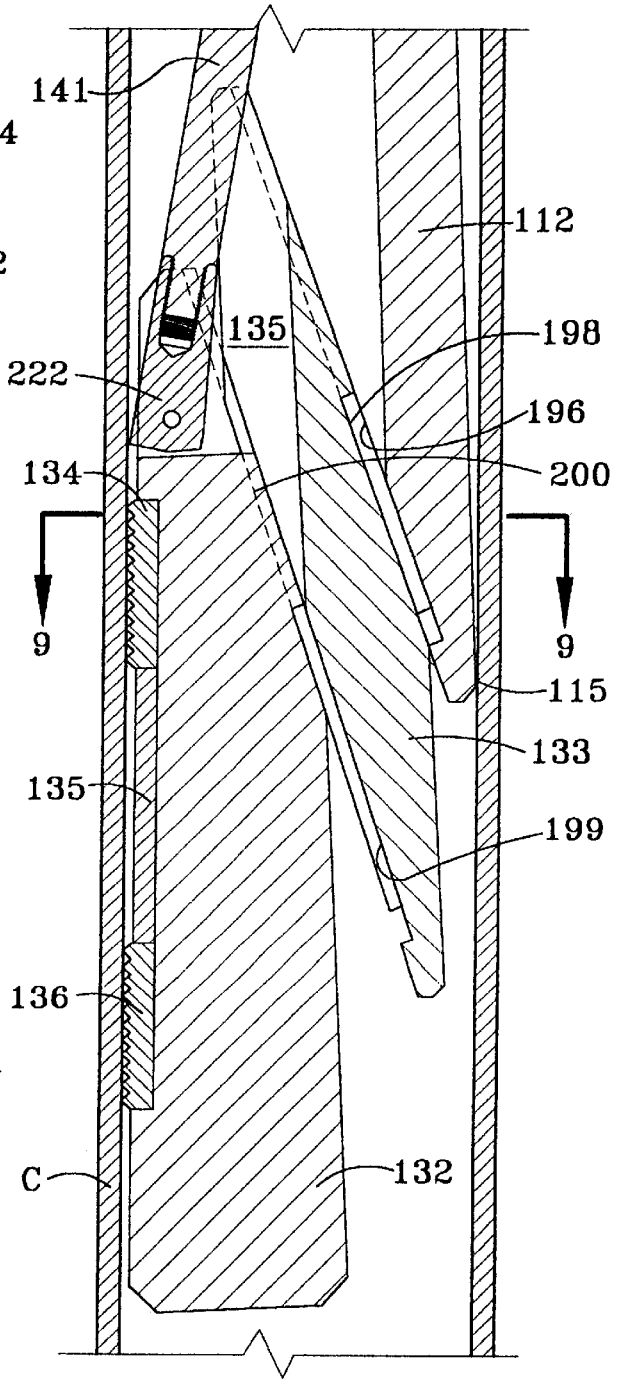

To set the tool as shown in FIG. 6, the fluid pressure will be increased to the actuator 142, which will then pull the rod 140 upward, thereby initiating sliding engagement of the mating surfaces 199 and 200 and the mating surfaces 196 and 198. As the assembly 110 moves to the set position, the rod portion 141 pivots out of a suitable slot 135 (see FIG. 7D) provided in the upper wedge 133, so that the rod portion 141 is tilted to the position shown in FIGS. 7C and 7D. Once the desired upward pull has been applied to the rod 140 so that the assembly is reliably set in the well, member 182 shears, as shown in FIG. 7B, thereby allowing the actuator 142 and at least a portion of the rod 140 to be returned to the surface while the whipstock and anchor assembly remains reliably set in the casing. Inadvertent release of the assembly 110 from the set position is prevented by the ratchet assembly 210. As shown in FIG. 7C, the latching rod 214 has moved upward within the ratchet subassembly 210 and is locked in that upward position to prevent downward movement of the wedge members 132 and 133 with respect to the whipstock body 112, thereby retaining assembly 110 set within the casing C.

The assembly 110 may be retrieved to the surface by lowering the suitable retrieval tool which may include a stinger which enters the bore 122 in the upper portion 116 of the whipstock and anchor assembly. The interior surface of a bore 122 thus provides a suitable whipstock retrieval surface for engagement with a retrieving tool (not shown) to retrieve the whipstock and anchor assembly to the surface. An alternate retrieval surface may be formed by threads on the outside of the upper end of the whipstock body. Once the retrieving tool is in engagement with the whipstock, an upward force applied through the retrieving tool to the whipstock body 112 will thus shear the pins 212 in the ratchet subassembly 210, thereby releasing the latching rod 214 from its fixed position with respect to the whipstock body 112, and thereby allowing downward movement of the bushing 216, which then returns the upper and lower slips 134, 136 to the run in position.

When the assembly 110 is in the set position shown as in FIG. 7, the whipstock body will desirably be positioned for engagement with a mill or other downhole tool. A lowered mill may thus initially engage the end surface 120 on the whipstock body, and the mill rotated while being lowered to simultaneously cut off the lug 121 while cutting an initial window into the casing C. As the whipstock is lowered further along the concave diversion face 124, the window in the casing is lengthened and widened. More particularly, it should be understood that the entirety of the whipstock body may be tilted in the casing, and that the back surface 119 of the whipstock body may thus be out of engagement with the casing when in the set position. In the set position, the top surface 118 of the whipstock is in planar engagement with the casing, while the lower surface 115 is in planar engagement with the opposing wall of the casing. This feature allows the whipstock body concave diversion face 124 to have a substantially uniform depth cut with respect to the otherwise exterior cylindrical surface of the whipstock body, although the uniform cut will still be angled or inclined as shown in FIG. 7B by the tilting of the whipstock body to the set position.

Those skilled in the art will understand that a plurality of conventional stops may be provided along the length of the mating surfaces 196, 198 and 199, 200 to ensure that the desired movement of each of the upper and lower wedges with respect to the whipstock body 112 is achieved during the setting operation. Guide pins may also be provided for ensuring sliding engagement of these surfaces, then stopping movement at a selected position dependant on the casing diameter.

Figure 8:
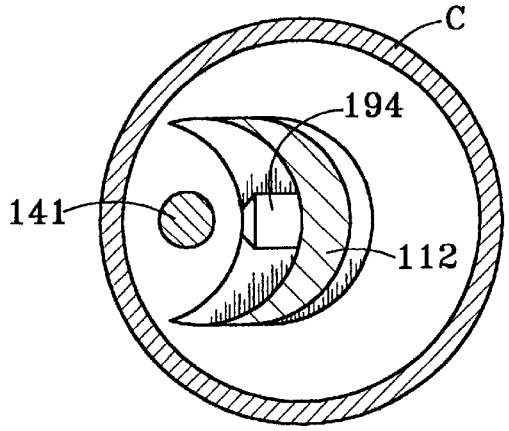
FIG. 8 is a cross section taken along lines 8—8 in FIG. 6D.
Figure 9:
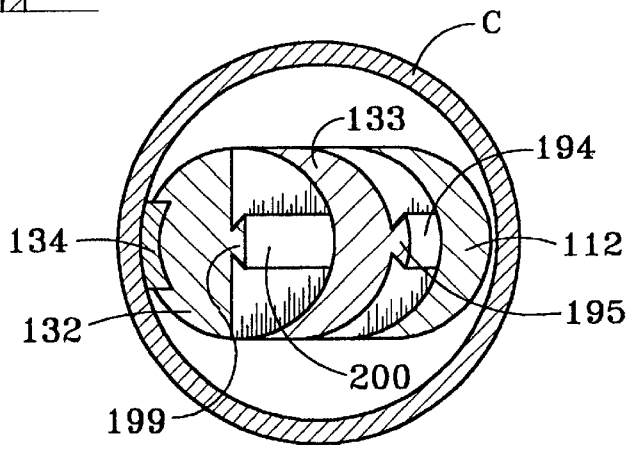
FIG. 9 is a cross section taken along lines 9—9 in FIG. 7D.

FIG. 8 is a cross sectional view which illustrates the position of the whipstock body 112 and the rod portion 141, and also illustrates the dovetail slot 194. FIG. 9 illustrates the upper and lower wedge members 132 and 133 and the whipstock body 112 in the set position, and more specifically illustrates the dovetail 195 position within the dovetail slot 194, then similarly the dovetail 199 positioned within the dovetail slot 200. The lower slip 136 is shown in biting engagement with the casing, although a similar slip is not provided on the whipstock body to enhance the ease of retrieving the assembly 110 to the surface.

A counterbalance was discussed above with respect to one of the two embodiments specifically shown in the drawings. Those skilled in the art will appreciate that the whipstock and anchor assembly of the present invention may be used with or without a counterweight. If a counterweight is not utilized, an indexing tool may be provided above the whipstock body for rotating the whipstock body to a selected position before the whipstock and anchor assembly is set in the casing. In other embodiments, an MWD tool may be provided for achieving the desired azimuth of the whipstock face in the casing. The retrievable version of the tool discussed herein is intended for a high side exit, which makes the assembly much more suitable for consequently retrieving the assembly to the surface. Retrieving tools are thus well suited to engage with a retrieval tool engaging surface at the upper end of the whipstock body when that surface is closely adjacent the low side of the casing. It should be remembered that, although the tool is shown in the attached figures in its vertical position, the whipstock and anchor assembly is primarily intended for use in highly deviated wells or lateral wells, wherein the well inclination is typically 30 degrees or more from a true vertical. The whipstock diversion face on the tool intended for retrieval thus is cut on the high side of the whipstock body for a high side exit, while the permanent assembly as shown in FIGS. 1–5 is a low side exit tool which has its whipstock diversion face on the low side of the whipstock body.

The particular angle of the mating sliding surfaces between the wedge and the whipstock body and between mating wedge members obviously affects the expansion of the anchor in response to a given axial movement of the rod. In the FIG. 1 the embodiment, which is permanently set in the well, a slip is preferably provided on both the whipstock body and the at least one wedge member, and the angle of the mating sliding surfaces when in the set position may be ten degrees or more with respect to the axis of the casing. For the embodiment which is retrievable as shown in FIG. 6, a slip preferably is not provided on the whipstock body, and only the lower exterior planar surface 115 of the whipstock body engages the casing when in the set position. Also, the angle of the mating surfaces preferably may be ten degrees or more for this embodiment, thus increasing the likelihood of that these surfaces will slidably release from the set position when an upward force is applied to the whipstock body to release the rod, and move the wedges assisted by gravity back to the run in position.

As noted above, various centralizers may be used to desirably position the whipstock and anchor assembly within the casing. One or more offset centralizers may be used to offset the position of whipstock and/or mill with respect to the casing. Also, various types of counterbalance tools may be used to position the whipstock and anchor assembly in a desired position prior to the setting operation. Those skilled in the art will also appreciate that various types of orientation tools such as tool 43 generally depicted in FIG. 1A may be used in conjunction with the whipstock and anchor assembly of the present invention, and that these orientation tools provide alternative techniques which enable the whipstock diversion face to be set at a desired azimuth relative to the casing. A whipstock and anchor assembly as disclosed herein may be intended for a low side mill exit, and may be altered to provide an exit for the mill at other circumferential locations.

Those skilled in the art will appreciate that a slip fabricated from material other than that used to form the whipstock body and the wedge members is preferably used for biting engagement with the casing. The term "slip" is used herein is intended in its broad sense to refer to any surface or member which is configured for biting engagement with the casing, and thus the slip and the wedge maybe formed from as a unitary body. Those skilled in the art will thus appreciate the various types of commercially available slips may thus be used on the wedges and on the whipstock body for biting engagement with the casing when in the set position. The whipstock and anchor tool of the present invention has been described in particular when a hydraulic actuator is used to move the assembly from the run in to the set position. Those skilled in the art will appreciate that other types of setting tools may be used for this purpose. If the whipstock and wedge assembly is run in on a wire line, for example, an explosive charge tool may be used to achieve the desired upward pull on the rod relative to the sleeve.

Those skilled in the art will appreciate the benefits of the whipstock and anchor assembly of the present invention being retrievable, and also the benefits of the assembly optionally being a thru tubing tool, such that the assembly may be lowered through a tubing or other restriction in a well and set within a casing having interior diameters substantially greater than the normal diameter of the restriction. The desires of the operator relative to retrieval of the tool and the particular conditions of the well will thus determine whether a permanent or a retrievable whipstock and anchor assembly is employed, and whether the whipstock and anchor assembly maximum run in diameter must be sized for passing through a particular restriction and then set in the much larger diameter casing. Both the angle of the mating sliding surfaces between the whipstock body and the one or more wedge members and the number of wedge members used in the anchor will thus be a function of the presence or absence of restrictions in the well above the location where the assemblies will be set, and the required expansion of the tool into the set position to reliably engage the casing. The whipstock and anchor assembly may thus be used in the thru tubing operation or in an operation which does not have any substantial restrictions in the well, and the tool may be designed for permanent engagement with the casing or may be designed to be retrieved at the surface after performing its diverting function. Restrictions in a well other than a tubing restriction may include a landing nipple or other type of sealing nipple with a restricted seal bore and/or a "no go" shoulder, a side pocket mandrel with restrictions, or a subsurface safety valve.

The foregoing description of the invention is thus explanatory of preferred embodiments. Those skilled in the art will appreciate that various changes in the size, shape, and materials, as well as the details of the illustrated construction, the combination of features, and the methods as discussed herein may be made without departing from the invention. While the invention has thus been described in detail for two specific embodiments, it should be understood that this explanation was for illustration, and the invention is not limited to these embodiments. Modifications to the apparatus and the methods as described herein will be apparent to those skilled in the art in view of this disclosure. Thus modifications may be made without departing from the invention, which is defined by the claims.

What is claimed is:

1. A combination whipstock and anchor assembly for setting in a casing, comprising:

a whipstock body having a whipstock diversion face for diverting a tool with respect to the casing, the whipstock body having a lower wedge engaging surface;

at least one wedge member moveable relative to the whipstock body, the at least one wedge member supporting a wedge slip thereon for anchored engagement with the casing, the at least one wedge member having a whipstock body engaging surface for sliding engagement with the lower wedge engaging surface on the whipstock body and;

an actuation member for moving the at least one wedge member relative to the whipstock body from a run in position to a set position; and a counterbalance positioned above the whipstock body when in the run in position, such that the counterbalance is positioned toward a low side of the casing when the at least one wedge member is in the set position.

2. The combination whipstock and anchor assembly as defined in claim 1, further comprising:

at least one whipstock body slip fixed to the whipstock body for anchored engagement with the casing.

3. The combination whipstock and anchor assembly as defined in claim 1, wherein the at least the one wedge member includes at least two axially spaced wedge slips thereon, each of the at least two axially spaced wedge slips engaging the casing when the whipstock and anchor assembly is in the set position.

4. The combination whipstock and anchor assembly as defined in claim 1, wherein the lower wedge engaging surface and the whipstock body engaging surface have a dovetail interconnection to allow sliding engagement while maintaining mating engagement of the surfaces.

5. The combination whipstock and anchor assembly as defined in claim 1, wherein the actuation member includes an elongate rod moveable with respect to the whipstock body to move the at least one wedge member from the run in position to the set position.

6. The combination whipstock and anchor assembly as defined in claim 5, wherein at least a portion of the whipstock body includes a thru bore for receiving the elongate rod.

7. The combination whipstock and anchor assembly as defined in claim 5, wherein the actuation member further comprises:

an actuator positioned above the whipstock body for moving the elongate rod.

8. The combination whipstock and anchor assembly as defined in claim 7, wherein the actuator is responsive to hydraulic pressure.

9. The combination whipstock and anchor assembly as defined in claim 5, further comprising:

a shear member positioned along the rod, such that the actuation member may move the at least one wedge member to the set position then shear the shear member, and thereafter at least a portion of the actuation member may be retrieved to the surface while the whipstock body and the at least one wedge member are in the set position.

10. The combination whipstock and anchor assembly as defined in claim 1, wherein the counterbalance positions the whipstock diversion face for a generally low side exit of the tool with respect to the casing.

11. The combination whipstock and anchor assembly as defined in claim 10, wherein the at least one wedge member comprises:

a lower wedge member;

an upper wedge member, the upper wedge member including the whipstock body engaging surface thereon;

the lower wedge member being slidable movable relative to the upper wedge member; and the actuation member being attached to the lower wedge member.

12. The combination whipstock and anchor assembly as defined in claim 1, wherein an upper end of the whipstock body is configured for engagement with an orienting tool for orienting the whipstock body at a selected azimuth within the well.

13. The combination whipstock and anchor assembly as defined in claim 1, further comprising:

the at least one wedge member positions a lowermost front face of the whipstock body radially aligned with the whipstock diversion face out of engagement with the casing when the at least one wedge member is in the set position.

14. The combination whipstock and anchor assembly as defined in claim 1, wherein the actuation member includes an elongate rod and a pivot mechanism for pivotally interconnecting the elongate rod and the at least one wedge member.

15. The combination whipstock and anchor assembly as defined in claim 1, wherein the whipstock diversion face includes a concave diversion face portion having a substantially uniform depth cut with respect to an exterior cylindrical surface of the whipstock body.

16. A combination whipstock and anchor assembly for setting in a casing, comprising:

a whipstock body having a whipstock diversion face for diverting a tool with respect to the casing, the whipstock body having a lower wedge engaging surface on a lower end of the whipstock body;

at least one wedge member slidably moveable relative to the whipstock body, the at least one wedge member supporting a wedge slip thereon for anchored engagement with the casing, the at least one wedge member having a whipstock body engaging surface for sliding engagement with the lower wedge engaging surface on the whipstock body;

an actuation member extending from above an upper end of the whipstock body to the at least one wedge member for moving the at least one wedge member upward relative to the whipstock body from a run in position to a set position; and an upper backside surface on an upper end of the whipstock body radially opposite the whipstock diversion face and configured for planar engagement with the casing when the at least one wedge member moves the whipstock body to a set position.

17. The combination whipstock and anchor assembly as defined in claim 16, further comprising:

a lower backside surface on a lower end of the whipstock body and radially opposite the whipstock diversion face and configured for engagement with the casing when the at least one wedge member moves the whipstock body to the set position, a front side of the whipstock body radially opposite the lower backside surface being out of engagement with the casing when the whipstock body is in the set position.

18. The combination whipstock and anchor assembly as defined in claim 17, further comprising:

the whipstock body including a backside undercut spaced axially between the upper backside surface and the lower backside surface for spacing a substantial length of the whipstock body from engagement with the casing.

19. The combination whipstock and anchor assembly as defined in claim 16, wherein an upper end of the whipstock is configured for engagement with an orienting tool for orienting the whipstock at a selected azimuth within the well.

20. The combination whipstock and anchor assembly as defined in claim 16, further comprising:

at least one whipstock body slip on the lower backside surface of the whipstock body for anchored engagement with the casing.

21. The combination whipstock and anchor assembly as defined in claim 16, wherein the actuation member includes an elongate rod and a pivot mechanism for pivotally interconnecting the elongate rod and the at least one wedge member.

22. The combination whipstock and anchor assembly as defined in claim 16, wherein the whipstock diversion face includes a concave diversion face portion having a substantially uniform depth out with respect to an exterior cylindrical surface of the whipstock body.

23. A combination whipstock and anchor assembly comprising:

a whipstock body having a whipstock diversion face for diverting a tool with respect to the casing, the whipstock body having a lower wedge engaging surface on a lower end of the whipstock body;

at least one wedge member slidably moveable relative to the whipstock body, the at least one wedge member supporting a wedge slip thereon for anchored engagement with the casing, the at least one wedge member having a whipstock body engaging surface for sliding engagement with the lower wedge engaging surface on the whipstock body;

an actuation member extending from above an upper end of the whipstock body to the at least one wedge member including an elongate rod movable with respect to the whipstock body for moving the at least one wedge member relative to the whipstock body from a run in position to a set position; and a ratchet mechanism positioned on a lower portion of the whipstock body for retaining the whipstock body and the at least one wedge member in the set position.

24. The combination whipstock and anchor assembly as defined in claim 23, further comprising:

a whipstock body includes a through passageway for receiving the elongate rod; and the ratchet mechanism is positioned within the through passageway in the lower portion of the whipstock body.

25. The combination whipstock and anchor assembly as defined in claim 23, further comprising:

the whipstock body including a through passageway for receiving the elongate rod;

a lower rod portion interconnecting the elongate rod within the through passageway and the at least one wedge member; and a pivot mechanism for pivotally interconnecting the elongate rod and the lower rod portion.

26. The combination whipstock and anchor assembly as defined in claim 23, further comprising:

a racket release mechanism on a lower portion of the whipstock body for releasing the whipstock body and the at least one wedge member from the set position.

27. The combination whipstock and anchor assembly as defined in claim 23, wherein an upper backside surface on the whipstock body radially opposite the whipstock diversion face is configured for planar engagement with the casing when the whipstock body is in the set position and a front side surface on the lower end of the whipstock body radially opposite the backside surface is configured for planar engagement with the casing when in the set position.

28. The combination whipstock and anchor assembly as defined in claim 27, wherein the whipstock diversion face includes a concave diversion face portion having a substantially uniform depth cut with respect to an exterior cylindrical surface of the whipstock body.

* * * * *